US009845650B2

(12) United States Patent
Evans et al.

(10) Patent No.: US 9,845,650 B2
(45) Date of Patent: Dec. 19, 2017

(54) RUNNING TOOL LOCK OPEN DEVICE

(71) Applicant: OneSubsea IP UK LImited, London (GB)

(72) Inventors: John T. Evans, Houston, TX (US); Cody C. Lam, Richmond, TX (US)

(73) Assignee: OneSubSea IP UK Limited, London (GB)

( * ) Notice: Subject to any disclaimer, the term of this patent is extended or adjusted under 35 U.S.C. 154(b) by 234 days.

(21) Appl. No.: 14/826,939

(22) Filed: Aug. 14, 2015

(65) Prior Publication Data

US 2017/0044858 A1 Feb. 16, 2017

(51) Int. Cl.

| | |
|---|---|
| ***E21B 23/01*** | (2006.01) |
| ***E21B 23/00*** | (2006.01) |
| ***E21B 43/10*** | (2006.01) |

(52) U.S. Cl.

CPC ..... *E21B 23/01* (2013.01); *E21B 23/006* (2013.01); *E21B 43/10* (2013.01)

(58) Field of Classification Search

CPC ..... E21B 43/10; E21B 23/006; E21B 17/06; E21B 23/01; E21B 33/04; E21B 33/1291; E21B 34/14

USPC ..... 166/123, 139, 332.2, 373, 382

See application file for complete search history.

(56) References Cited

U.S. PATENT DOCUMENTS

| | | | | |
|---|---|---|---|---|
| 5,103,902 | A * | 4/1992 | Ross | E21B 23/06 166/120 |
| 5,690,172 | A * | 11/1997 | Westra | E21B 23/06 166/123 |
| 2008/0210063 | A1* | 9/2008 | Slack | E21B 19/06 81/420 |
| 2012/0061528 | A1* | 3/2012 | Roth | E21B 19/07 248/65 |
| 2014/0102703 | A1* | 4/2014 | Mailand | E21B 23/006 166/279 |
| 2015/0041151 | A1* | 2/2015 | Cocker, III | E21B 33/0415 166/380 |
| 2015/0096766 | A1* | 4/2015 | White | E21B 23/00 166/382 |

OTHER PUBLICATIONS

Anonymous, "Subsea Wellheads for deep and shallow water applications," Brochure, Cooper Cameron Corporation, Mar. 2015: pp. 1-8.

* cited by examiner

*Primary Examiner* — Carib A Oquendo
(74) *Attorney, Agent, or Firm* — Chamberlain Hrdlicka

(57) ABSTRACT

A lock open device for a running tool including a mandrel, the device including a collar located on the mandrel of the running tool and having an open position profile and a slot comprising a rotational travel section and an axial travel section. The lock open device also includes a top plate having a cog configured to engage with the open position profile to restrict the collar from relative rotation and a can including a pin configured to engage with the collar slot, in which the collar is rotatable upon overcoming a resistance of the top plate such that the pin is located in the axial travel section, allowing axial movement of the collar relative to the can.

9 Claims, 16 Drawing Sheets

RUNNING TOOL LOCK OPEN DEVICE

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

When preparing a well for production, an open hole may be lined with pipes known as casings to stabilize the borehole and protect the borehole from contaminants. One or more pipes may be coupled, connected, or otherwise joined together to form a casing string. Although one casing string may be used, multiple casing strings may be run through a wellhead assembly and into a borehole using a device such as a running tool.

Running tools may be used in the oil and gas industry to run, set, retrieve, or otherwise position, equipment or other tools within a borehole. Running tools may include a traveling block, for example, or may refer to a variety of tools such as wireline tools, slickline tools, and coiled tubing tools, among many others.

BRIEF DESCRIPTION OF THE DRAWINGS

For a detailed description of the embodiments of the invention, reference will now be made to the accompanying drawings in which.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are used in an open-ended fashion, and thus should be interpreted to mean "including, but not limited to . . . ." Also, any use of any form of the terms "connect," "engage," "couple," "attach," "mate," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis, and the term "rotational" generally means along a circumference, portion of a circumference, helical or other rotational path around the central axis. For instance, an axial distance refers to a distance measured along or parallel to the central axis, a radial distance means a distance measured perpendicular to the central axis, and a rotational distance means a distance measured along a path around the central axis. The use of "top," "bottom," "above," "below," "upper," "lower," "up," "down," "raise," "lower," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Figure 1A:
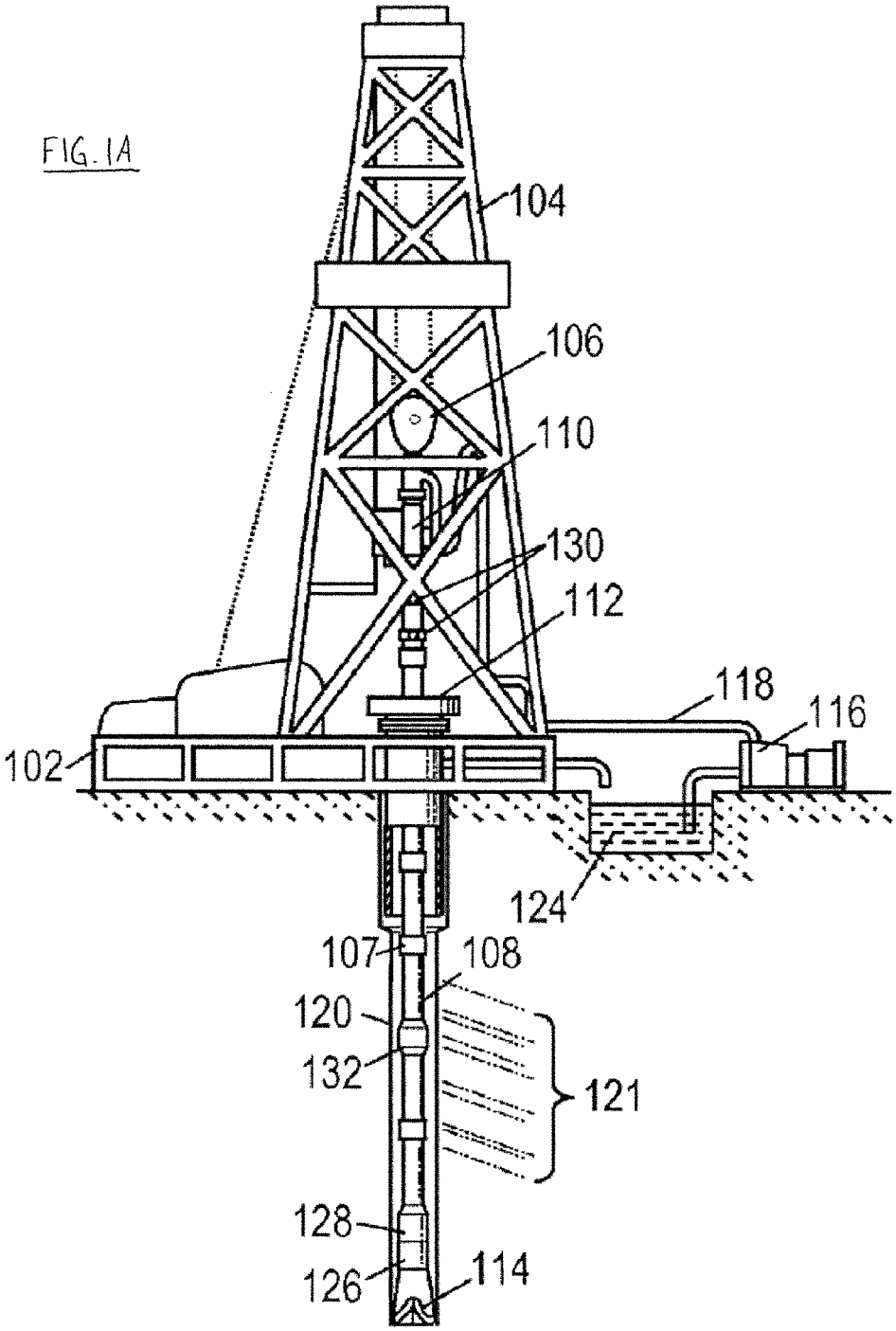
FIG. 1A is an illustrative view of an oilfield in accordance with one or more embodiments of the present disclosure.

Referring now to FIG. 1A, an illustrative oilfield environment is shown. A drilling platform 102 is equipped with a derrick 104 that supports a hoist 106 for raising and lowering a drill string 108. The hoist 106 suspends a top drive 110 that rotates the drill string 108 as the drill string is lowered through the wellhead 112. Sections of the drill string 108 are connected by threaded connectors 107. Connected to the lower end of the drill string 108 is a drill bit 114. As bit 114 rotates, a borehole 120 is created that passes through various formations 121 of the earth. A pump 116 may be used to circulate drilling fluid through a supply pipe 118 to top drive 110, through the interior of drill string 108, through orifices in drill bit 114, back to the surface via the annulus around drill string 108, and into a retention pit 124. The drilling fluid transports cuttings from the borehole into the pit 124 and aids in maintaining the integrity of the borehole 120.

Various other components may also be included in the drill string 108. For example, in wells employing telemetry, downhole sensors or transducers (e.g., within resistivity logging or induction tool 126) may be coupled to a telemetry module 128 having a transmitter (e.g., acoustic telemetry transmitter) that may continuously or intermittently transmit telemetry signals or data (e.g., in the form of acoustic data or vibrations in the tubing wall of drill string 108). A receiver array 130 may be coupled to tubing below the top drive 110 to receive transmitted signals. One or more repeater modules 132 may be optionally provided along the drill string to receive and retransmit the telemetry signals. Of course other telemetry techniques can be employed within the scope of this disclosure including mud pulse telemetry, electromagnetic telemetry, and/or wired drill pipe telemetry, for example. Further, signals or data transmitted may be in any form known in the art, including without limitation electric or electro-magnetic signals or data. Many telemetry techniques also offer the ability to transfer commands from the surface to the tool, thereby enabling adjustment of the tool's configuration and operating parameters. In some embodiments, the telemetry module 128 also or alternatively stores measurements for later retrieval when the tool returns to the surface.

Figure 1B:
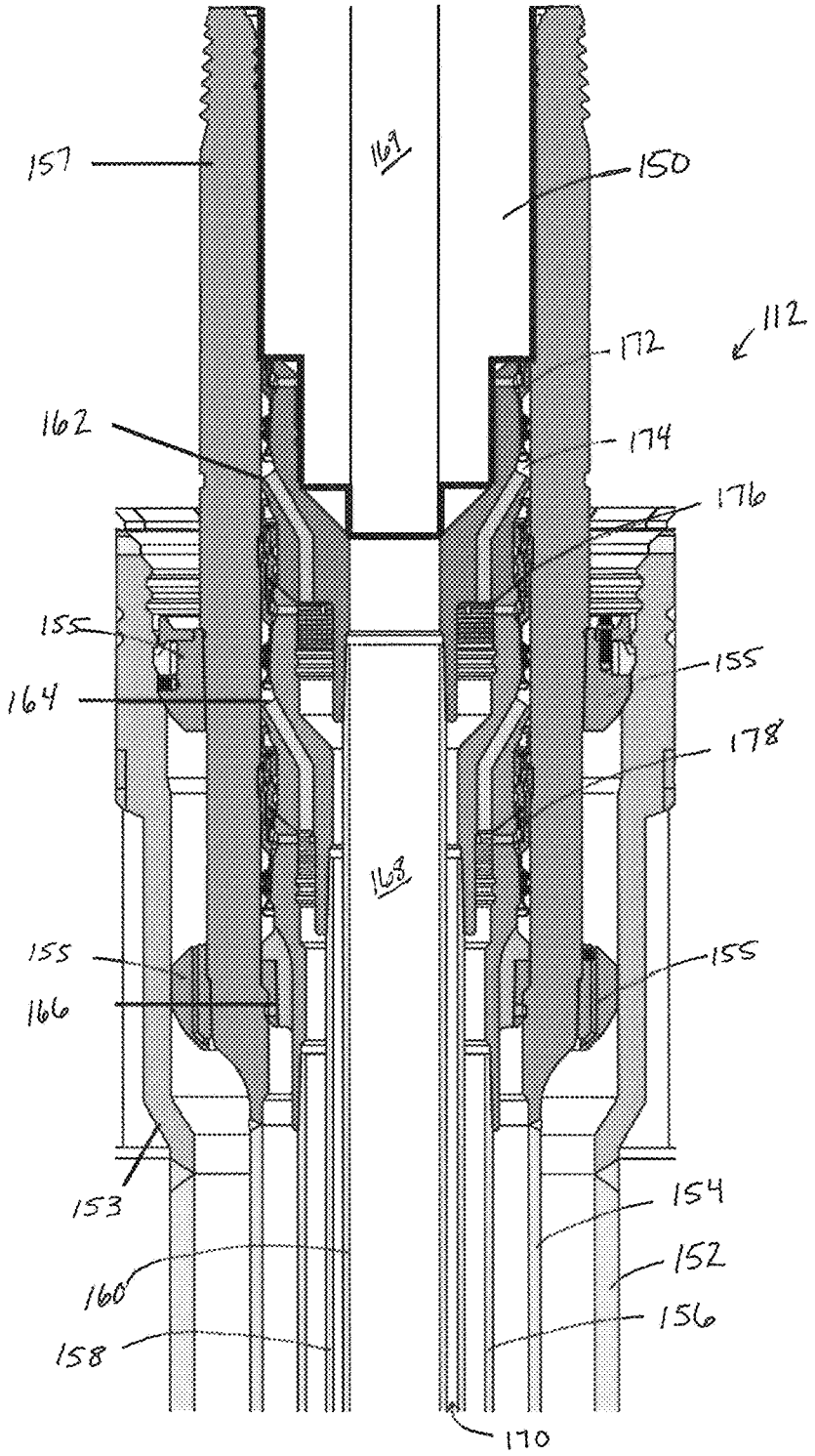
FIG. 1B is a cross-sectional view of a wellhead in accordance with one or more embodiments of the present disclosure.

Referring now to FIG. 1B, a cross-sectional view of a wellhead 112 in accordance with one or more embodiments is shown. At various times during the drilling process, the drill string 108 may be removed from the borehole and casing may be installed in the borehole 120 through wellhead 112. Installation of a casing string may be completed by performing a number of processes. For example, installation of a casing string may include running the casing string into the borehole 120, positioning the casing string within the borehole 120, cementing the casing string in place by pumping cement through a bore of the casing string and along an outside of the casing string, and sealing the casing hanger. As will be appreciated, not all processes mentioned herein are needed for installing a casing string, and other processes may be performed in addition to or in the alternative to the above mentioned processes.

Although a single casing string may be installed within a borehole 120, multiple casing strings may be used, as shown in FIG. 1B. For example, when drilling a borehole 120, a first section of the borehole 120 may be drilled using drill string 108, and the drill string 108 may be pulled out of the borehole 120. Thereafter, a casing string, such as conductor pipe 152 may be installed within the borehole 120. The conductor pipe 152 may be the preliminary casing string run in a borehole 120 and may be connected to or integral with a conductor head 153. After the conductor pipe 152 is installed, the drill string 108 may be used to further drill the borehole 120 until a particular depth is reached. The depth may depend on equipment limitations or may depend on the location of potential hydrocarbon reservoirs, among other factors.

After reaching the particular depth, the drill string 108 may then be pulled out of the borehole 120 and another casing string, such as surface casing 154, may be installed in the borehole 120. The surface casing 154 may be sealed against conductor head 153 using one or more seal assemblies 155. The surface casing 154 may be connected to or integral with wellhead housing 157 in which casing hangers may be hung and sealed, as will be discussed below.

The drilling and installing process may be repeated for multiple casing strings. As will be appreciated, in one or more embodiments, each of the casing strings installed in the borehole 120 is of a different size, shape, and/or composition. For example, as shown in FIG. 1B, intermediate casing strings 156, 158, and 160 may be installed in the borehole 120 through the wellhead 112. Conductor pipe 152 may be 30 inches in diameter, while surface casing 154 is 20 inches in diameter. Intermediate casings 156, 158, and 160 may be 13⅜ inches in diameter, 9⅝ inches in diameter, and 7 inches in diameter, respectively. In other embodiments, casing strings installed within a borehole 120 may be of similar or varying size, shape, and/or composition, or any combinations of the foregoing. Other diameters for the casing strings may be considered without departing from the scope of the present disclosure.

To install casing, a casing string may be hung on a hanger and positioned within the borehole 120 using a running tool 150. A running tool 150 may be connected to a drill string and may include a number of engagement points (not shown). The running tool 150 may also include other components used to run casing or other equipment into the borehole. As will be appreciated, the running tool 150 may be used to retrieve downhole tools or equipment, as is known in the art.

The running tool 150 may be configured to run a casing string, casing hanger, and seal assembly through the wellhead 112 and into a borehole 120. In one or more embodiments, each casing string may be hung on a corresponding hanger and landed in at least one of the conductor head 153, the wellhead housing 157, or a previously installed casing hanger. For example, as shown in FIG. 1B, the running tool 150 may engage with a casing hanger 162 and run casing string 160 into casing string 158. The running tool 150 may be used to position casing string 160 within casing string 158 and land casing hanger 162 in casing hanger 164 attached to casing string 158. In one or more embodiments, casing hanger 164 may be previously installed and landed within casing hanger 166 attached to intermediate casing string 156.

Once the casing hanger 162 has landed within casing hanger 164, cement may be pumped through a bore 168 of casing string 160 and around an annulus 170 between casing string 160 and casing string 158. The cement is allowed to set, and a seal assembly 172 may be activated in order to seal annulus 174 between the casing hanger 162 and the wellhead housing 157. As also shown, seal assemblies 176 and 178 may be located in the wellhead 112 and activated in order to seal against wellhead housing 157 and prevent leakage between casing hangers 164 and 166.

Figure 1C:
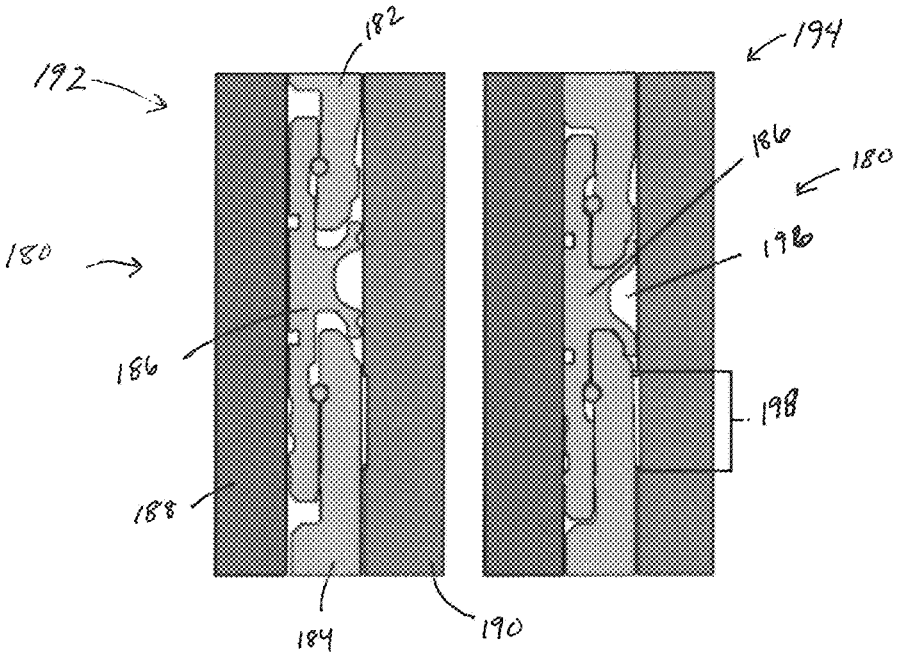
FIG. 1C is a cross-sectional view of a seal assembly in accordance with one or more embodiments of the present disclosure.

Referring now to FIG. 1C, a cross-sectional view of an example seal assembly in accordance with one or more embodiments is shown. In one or more embodiments, a seal assembly 180 may include a number of components designed to seal against a wellhead housing, such as wellhead housing 157 in FIG. 1B, or other components in a borehole 120 or wellhead 112. As shown, seal assembly 180 may include an upper seal 182, a lower seal 184, and a middle seal 186, and may be used to seal between a casing hanger 188 and a wellhead housing 190, for example and without limitation, by moving between an open position 192 and a sealed position 194. As will be appreciated, the seal assembly 180 may be used to seal between any components known in the art.

To activate the seal assembly 180 a running tool, such as running tool 150 in FIG. 1B, may be used to direct upper seal 182 toward lower seal 184 and form a seal as shown by sealed position 194. In some embodiments, lower seal 184 may be directed toward upper seal 182 or both upper and lower seals 182 and 184 may be directed toward each other. Directing the seals may be performed by activating pistons in a running tool, casing hanger, or other downhole equipment to push one or more of the upper and lower seals 182 and 184 toward one another. In one or more embodiments, the running tool may include a mandrel 169 (as shown in FIG. 1B), which may be used to engage, position, and/or operate equipment (such as activating a seal assembly) in the borehole 120. Those having ordinary skill in the art would appreciate that a number of other operations may be performed in order to move the seal assembly from an open position 192 to a sealed position 194. Also as shown, optional sealing components may be placed within open portions 196 and 198.

In one or more embodiments, a running tool may be configured to perform a number of operations in a particular order. For example, during well completion, a casing string may be run through a wellhead assembly at a surface end of a borehole using a running tool. The casing string may be hung from a casing hanger, and the casing hanger may be landed onto a wellhead or another previously installed casing hanger. Next, as described above, the casing string may be cemented into place within the borehole, and a seal assembly may then be set in order to seal an annulus between the wellhead assembly and the casing hanger.

In order to prevent a running tool from performing certain operations prematurely, a lock open device may be used. In one or more embodiments of the present disclosure, a lock open device may be used in combination with or separate from a running tool or may be included therein. In some embodiments, the lock open device may be integral or a part of the running tool.

Figure 2A:
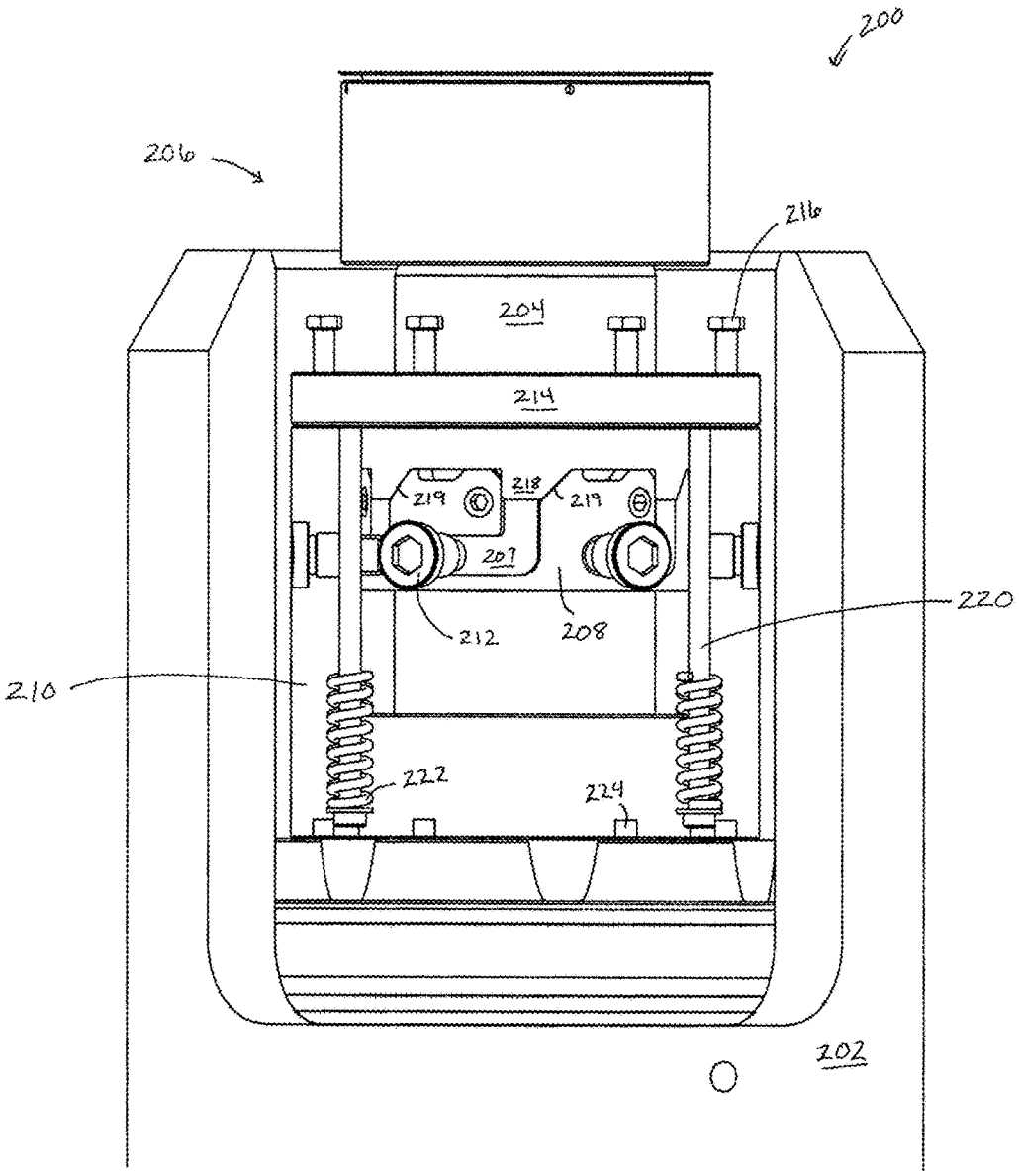
FIGS. 2A-2E are cross-sectional cut away views showing operation of a lock open device in accordance with one or more embodiments of the present disclosure.

Referring now to FIG. 2A, a cross-sectional cut away view of a lock open device 200 is shown. The lock open device 200 includes a body 202 around and/or adjacent to a mandrel 204 of a running tool 206. The device 200 may also include a collar 208 that may be attached, coupled, or otherwise connected to the mandrel 204. For example, the collar 208 may be attached to the mandrel 204 using set screws (as shown) or any other form of connection known in the art. In such a configuration, rotation of the mandrel 204 causes the collar 208 to rotate as well.

The lock open device 200 also includes a can 210 having one or more pins 212 located thereon or connected thereto. Each of the one or more pins 212 may be configured to engage with a slot 207 formed within the collar 208, as will be described in more detail below. The can 210 may be configured to allow a top plate 214 to be set thereon.

The top plate 214 may include one or more screws 216, one or more cogs 218, and one or more rods 220. The screws 216 may be configured to displace (i.e., raise or lower) the top plate 214 from the can 210 or bias the top plate 214 down onto the can 210 using a biasing mechanism, such as biasing mechanism 222 for example. The top plate 214 may be displaced from the can 210 by rotating the screws 216 through corresponding threaded holes within the top plate 214. The cogs 218 may extend from the top plate 214 and may be configured to engage with the collar 208. As shown, the cogs 218 are formed integrally with the top plate 214, but those having ordinary skill would appreciate that the cogs may be formed separate from the top plate 214 and connected or attached thereto.

Each of the rods 220 may be connected or attached to the top plate 214. For example, the rods 220 may be screwed into top plate 214. The rods 220 may extend through the can 210 and may engage with a biasing mechanism 222. The biasing mechanism 222 may be housed within the can 210, as shown. However, those having ordinary skill in the art would appreciate that the biasing mechanism 222 may be placed outside of the can 210, along the can 210, at the top plate 214, or at any other location. The biasing mechanism 222 (e.g., a spring) may be configured to bias the top plate 214 onto the can 210 and may act as a resistance force when screws 216 displace the top plate 214 from the can 210. The lock open device 200 may also include one or more dowel pins 224 to provide alignment (or other alignment or locating device known in the art), as will be described below.

Although the components of the lock open device 200 illustrated in FIGS. 2A-2E are arranged with respect to one another as shown, those having ordinary skill in the art would appreciate that other arrangements of the components may be considered without departing from the scope of the present disclosure.

Referring now to FIGS. 4A-4D, side views of a collar profile 231 are shown in accordance with one or more embodiments of the present disclosure. As shown in FIGS. 4A-4E, top plate 214 includes a cog 218. Collar 208 may include a slot 207 having a rotational travel section 201 and an axial travel section 203. The slot 207 may be configured to guide a pin, such as pin 212 of can 210, along or within the rotational travel section 201 and/or along or within axial travel section 203.

The collar profile 231 may be considered an open position profile in that the configuration of the profile 231 may enable the lock open device 200 to allow rotational movement of the collar 208 relative to the can 210. The collar profile 231 also may be considered an anti-return profile if the configuration of the profile 231 enables the lock open device 200 to allow axial movement of the collar 208 relative to the can 210, while restricting rotational movement of the collar 208 with respect to the can 210.

In one or more embodiments, a profile 231 may be formed within a collar 208. Although formed within collar 208, as shown, one or more profiles may be formed within the collar 208, can 210, top plate 214, and/or mandrel, among other components, without departing from the scope of the present disclosure.

Figure 4A:
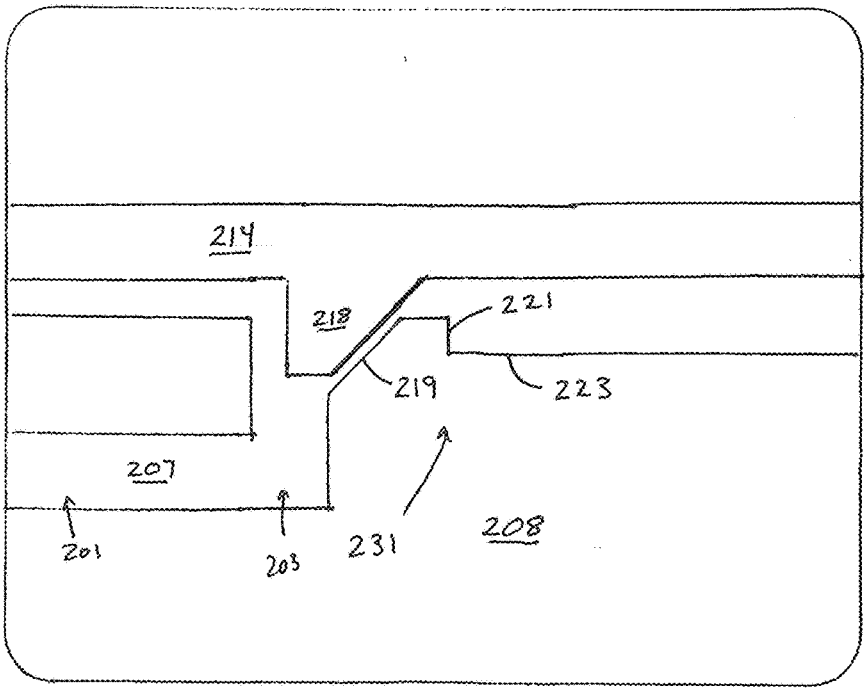
FIGS. 4A-4D are cross-sectional side views showing collar profiles in accordance with one or more embodiments of the present disclosure.

Further, multiple profiles, possibly of different configurations, may be formed within a collar 208. Indeed, a variety of different profile arrangements, shapes, and configurations may be considered without departing from the scope of the present disclosure. For example, profiles 231 are shown in FIGS. 4A-4D in an open position profile. In FIG. 4A, an open position profile 231 of the arrangement and configuration illustrated in FIGS. 2A-2E is shown. The open position profile 231 may include a ramp 219 configured to engage with a cog 218. The cog 218 may slide (or otherwise move) along ramp 219 and into anti-return slot 223. Once positioned in anti-return slot 223, rotation of the collar 208 may be restricted by engagement of the cog 218 with an edge 221 of anti-return slot 223 configured to mate with cog 218. In this position (not shown in FIG. 4A), the lock open device may be considered to be in the anti-return profile. The cog 218 and/or the anti-return slot 223 may be configured to mate with each other such that once the cog 218 is positioned in the anti-return slot 223, relative movement between the collar 208, the can 210, and the top plate 214 may be restricted and/or prevented.

Figure 4B:
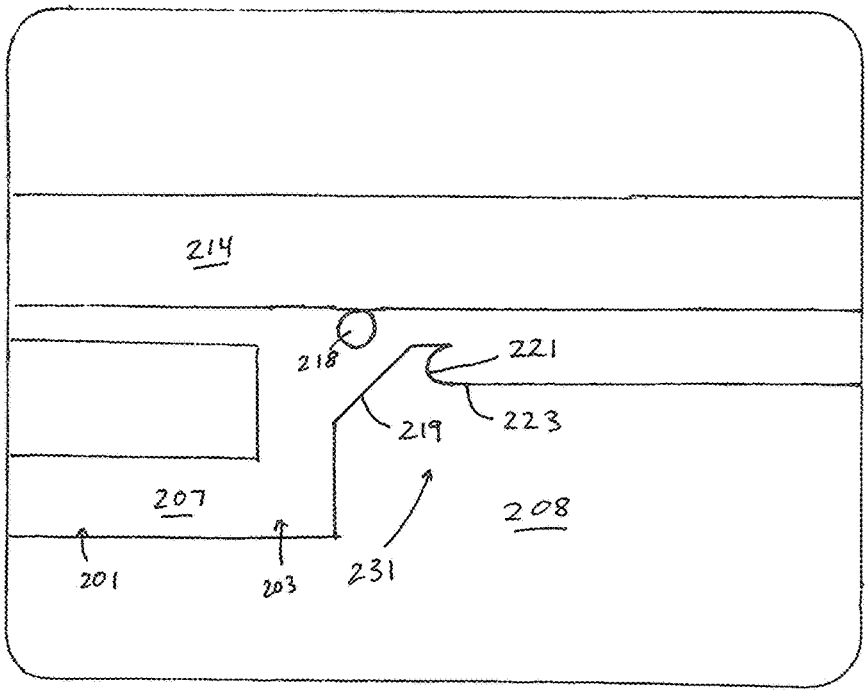
Figure 4C:
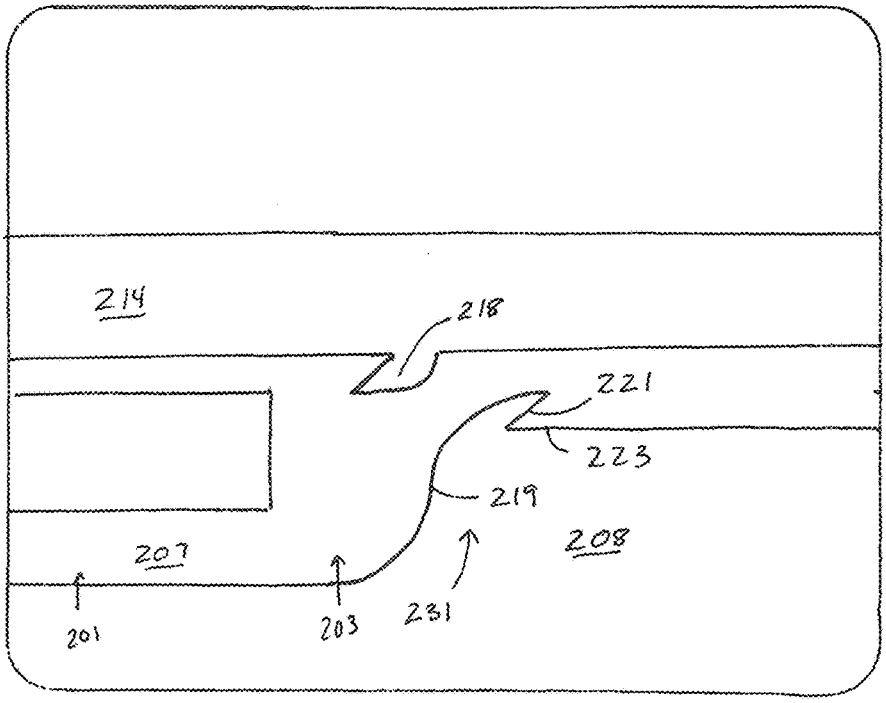
Figure 4D:
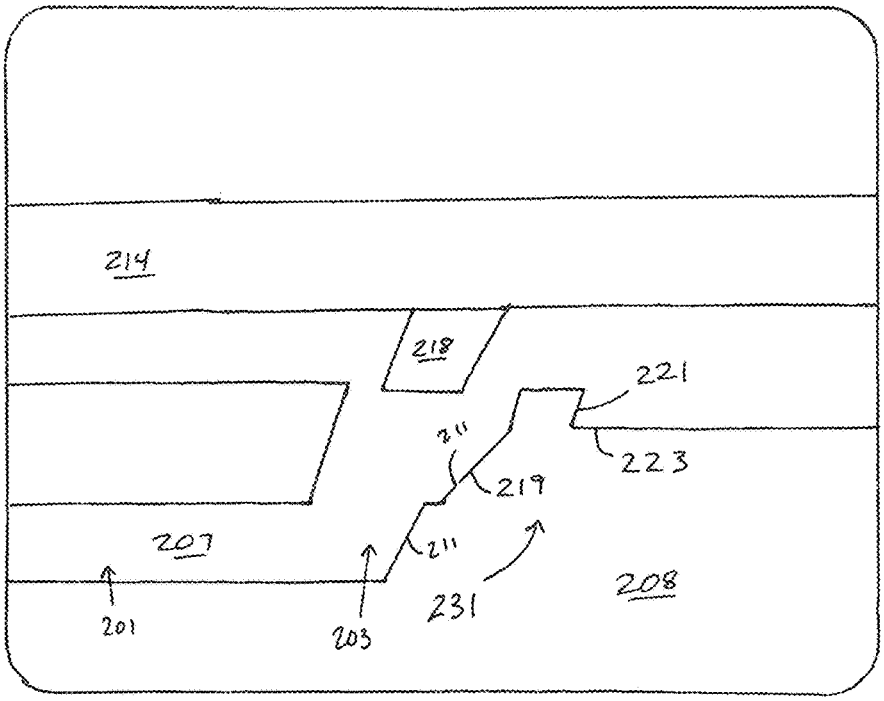

Other examples of profiles 231 are shown in FIGS. 4B-4D. For instance, as shown in FIG. 4B, a cross section of cog 218 may include a circular or curved shape, or may be spherical, cylindrical, or any other shape known in the art. The cog 218 may be configured to mate with a curved edge 221 of anti-return slot 223. As shown in FIG. 4C, ramp 219 formed within collar 208 may have a curved shape and may be configured to engage with a curved shape of cog 218. In addition, cog 218 may include an angled portion configured to mate or engage with edge 221 of anti-return slot 223. In another example, as shown in FIG. 4D, ramp 219 may include a number of steps 211. The steps 211 may be formed at different angles relative to horizontal in order to provide varying resistance forces when cog 218 slides along ramp 219 and into engagement with anti-return slot 223. As shown, cog 218 has an angled shape configured to engage with edge 221 of anti-return slot 223. Those having ordinary skill in the art would appreciate that many open position profiles 231 exist that a cog 218 of a top plate 214 may engage with in order to allow or restrict relative movement between components.

Further, although the illustrative embodiments in FIGS. 4A-4D depict a single cog, a single slot, and a single anti-return slot, among other items, multiple cogs, slots, and/or anti-return slots, among other items may be used in accordance with one or more embodiments of the present disclosure.

Referring back to FIGS. 2A-2E, each of the rods 220 may be connected to the top plate 214 and extend through the can 210. A portion of each of the rods 220 may engage with a biasing mechanism 222 housed within the can 210.

In one or more embodiments, the lock open device 200 may be set in an open position on a running tool 206 after a seal assembly (such as seal assembly 180 in FIG. 1C) and the running tool are engaged with a casing hanger, as shown in FIG. 1B (see, e.g., running tool 150, seal assembly 172, casing hanger 162). Referring again to FIGS. 2A-2E, to operate the lock open device 200, torque may be applied to the mandrel 204. At a predetermined torque value, the cog 218 may slide along a ramp 219. Although cog 218 is shown configured to engage with ramp 219, it should be understood that multiple cogs may engage with one or more ramps without departing from the scope of the present disclosure. The predetermined torque value may depend on a slope of the ramp 219 or the force of the biasing mechanism 222, or both. For example, a steeper slope of the incline may result in a higher resistance such that the predetermined torque value needed to overcome the resistance is higher, while a less steep slope may result in less resistance such that the predetermined torque value needed to overcome the resistance is lower. Further, a stronger biasing mechanism force may result in a higher predetermined torque value, while one or more cogs engaging with one or more ramps may also result in a higher predetermined torque value. The resistance may also depend on the profiles formed in the collar 208, as shown and described above in FIGS. 4A-4D.

As shown, the ramp 219 may extend from the slot 207 and form an angle. For a non-limiting example, the angle may be between about 45° and about 75° with respect to horizontal. In some embodiments, the angle of the ramp 219 may vary or incrementally change about the length of the ramp 219, as will be discussed below.

In one or more embodiments, the form of ramp 219 may be based on the one or more cogs 218. For example, a ramp 219 may be formed such that the shape is complementary to the one or more cogs 218. In addition, although the ramp 219 is illustrated in FIGS. 2A and 4A (for example) as an incline, the ramp 219 may be any shape, such as a curve or stepped shape, among others, as discussed above with reference to FIGS. 4C-4D.

Figure 2B:
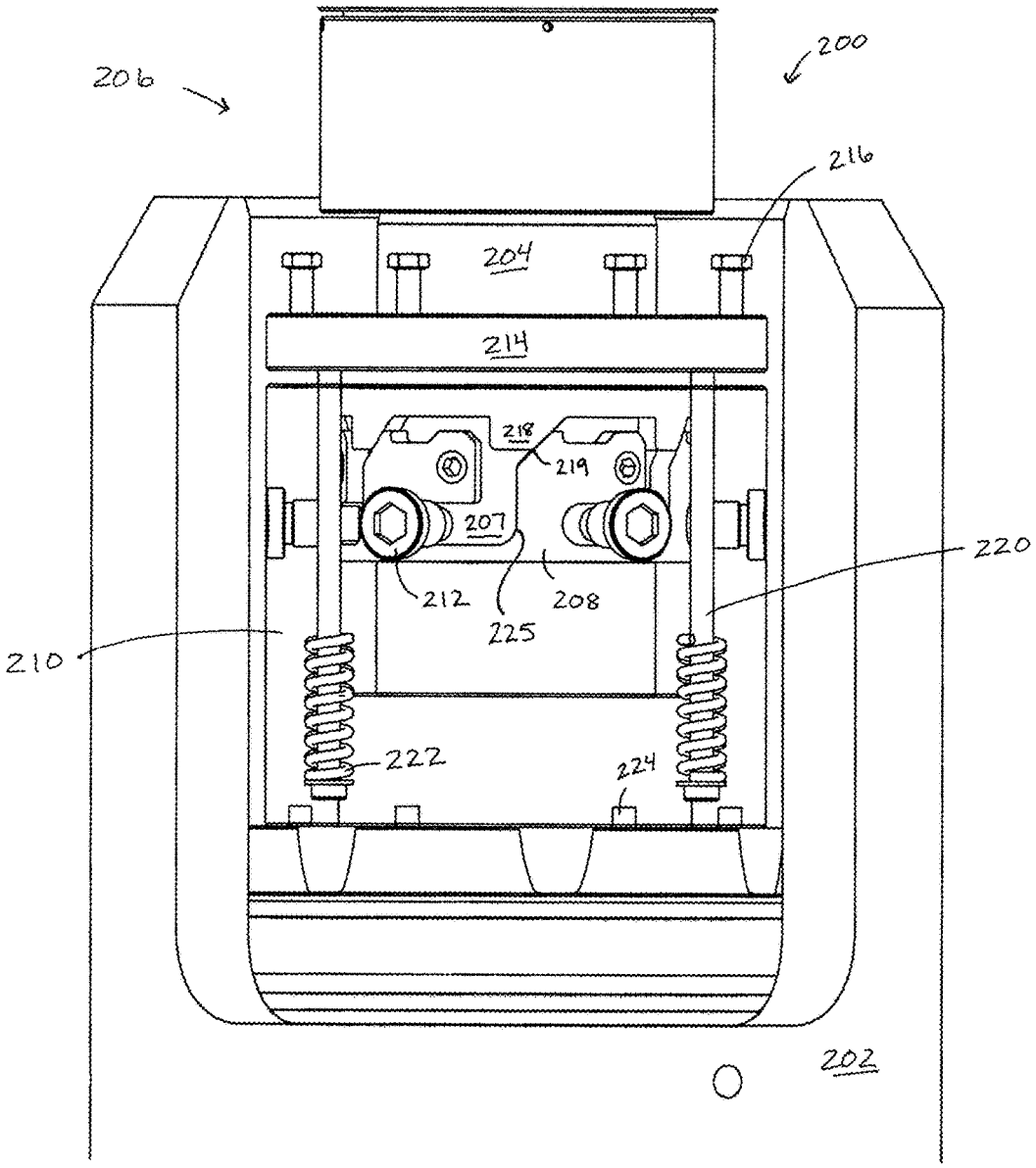
Figure 2C:
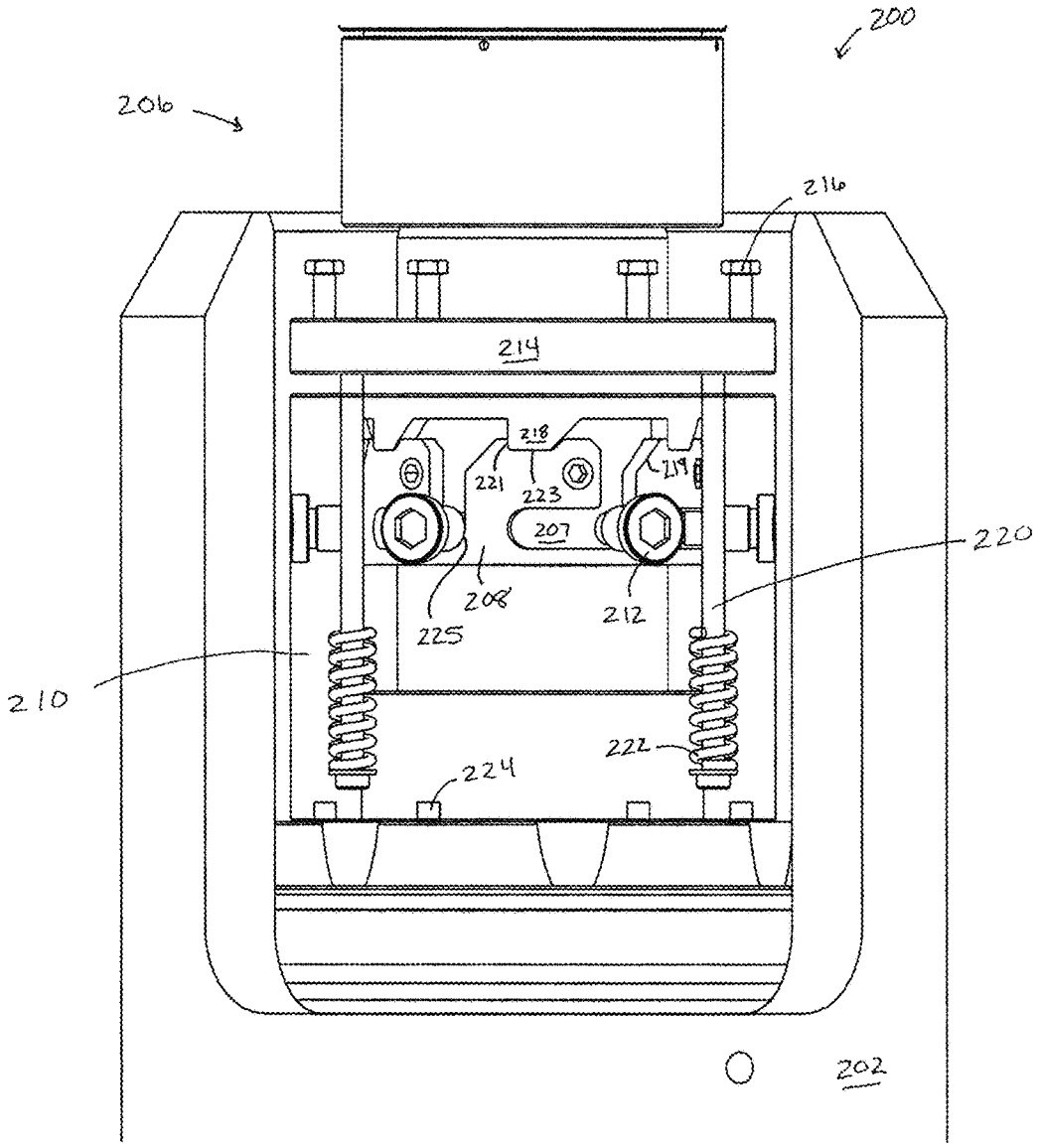

As torque is applied, the cog 218 slides (or otherwise moves) along the ramp 219, as shown in FIG. 2B. After sliding along the ramp 219, the cog 218 may land in an anti-return slot 223 formed within the collar 208 (see also FIGS. 4A-4D). The anti-return slot 223 may be configured to prevent the cog 218 from sliding back down the ramp 219. The anti-return slot 223 may be formed to complement the shape of the cog 218. In addition, or in the alternative, as shown in FIG. 2C a steep edge 221 may be formed within the collar 208 and used to prevent backward movement of the cog 218. As the cog 218 slides up the ramp 219 and lands in the anti-return slot 223, one or more pins 212 of the can 210 slide along slot 207 and reach an end or edge 225 of a horizontal portion of the slot 207. In this position, the pins 212 are unable to move any further horizontally in order to prevent drill pipe wind up and/or premature unlocking of the running tool from the casing hanger. In addition, once the cog 218 lands in anti-return slot 223, relative motion between the can 210 and the collar 208 is restricted. For example, the collar 208 and the can 210 may be configured to rotate with respect to each other, while being able to move axially independent of each other. In other embodiments, the collar 208 and the can 210 may be allowed to rotate independent of one another, while axial movement relative to each other is restricted.

Figure 2D:
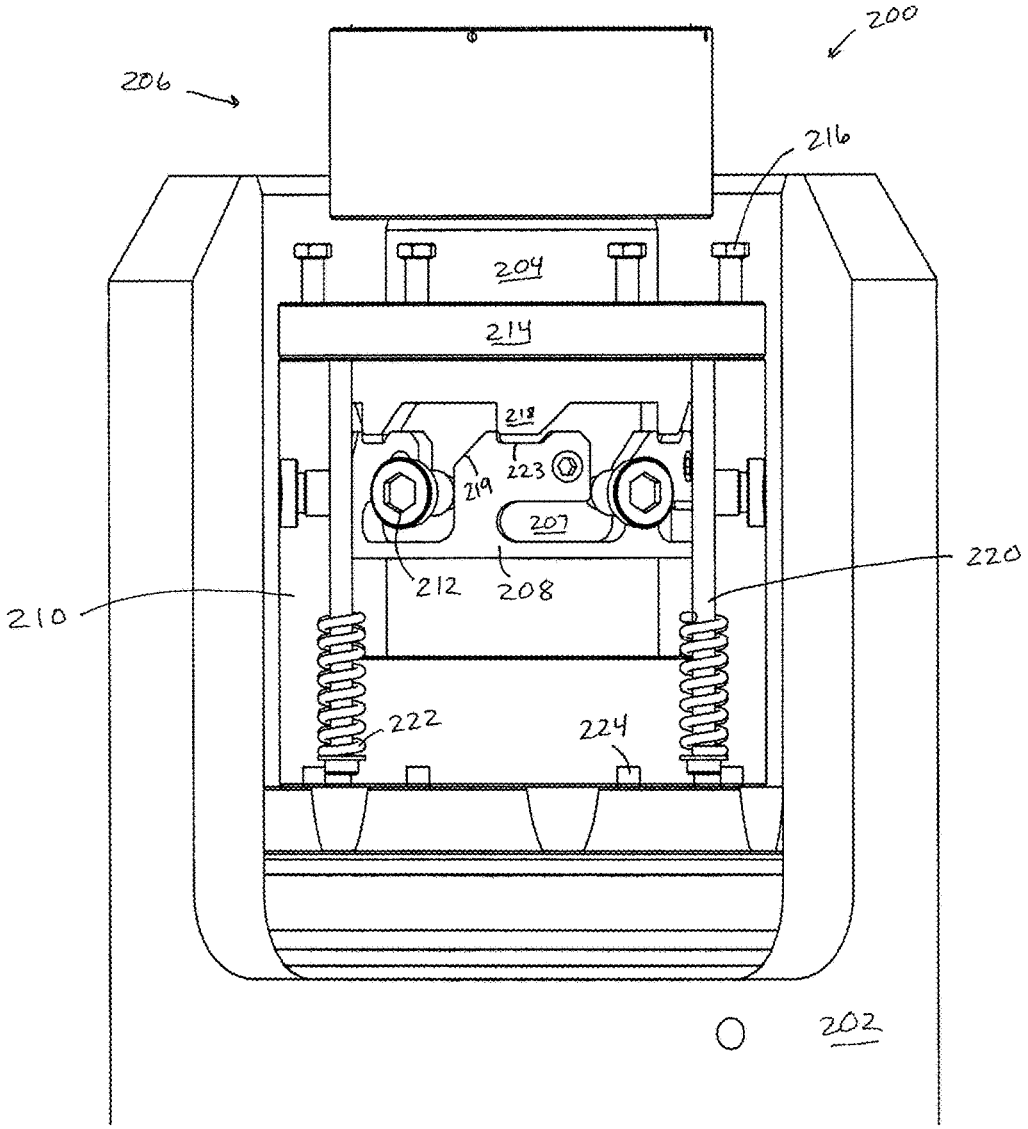
Figure 2E:
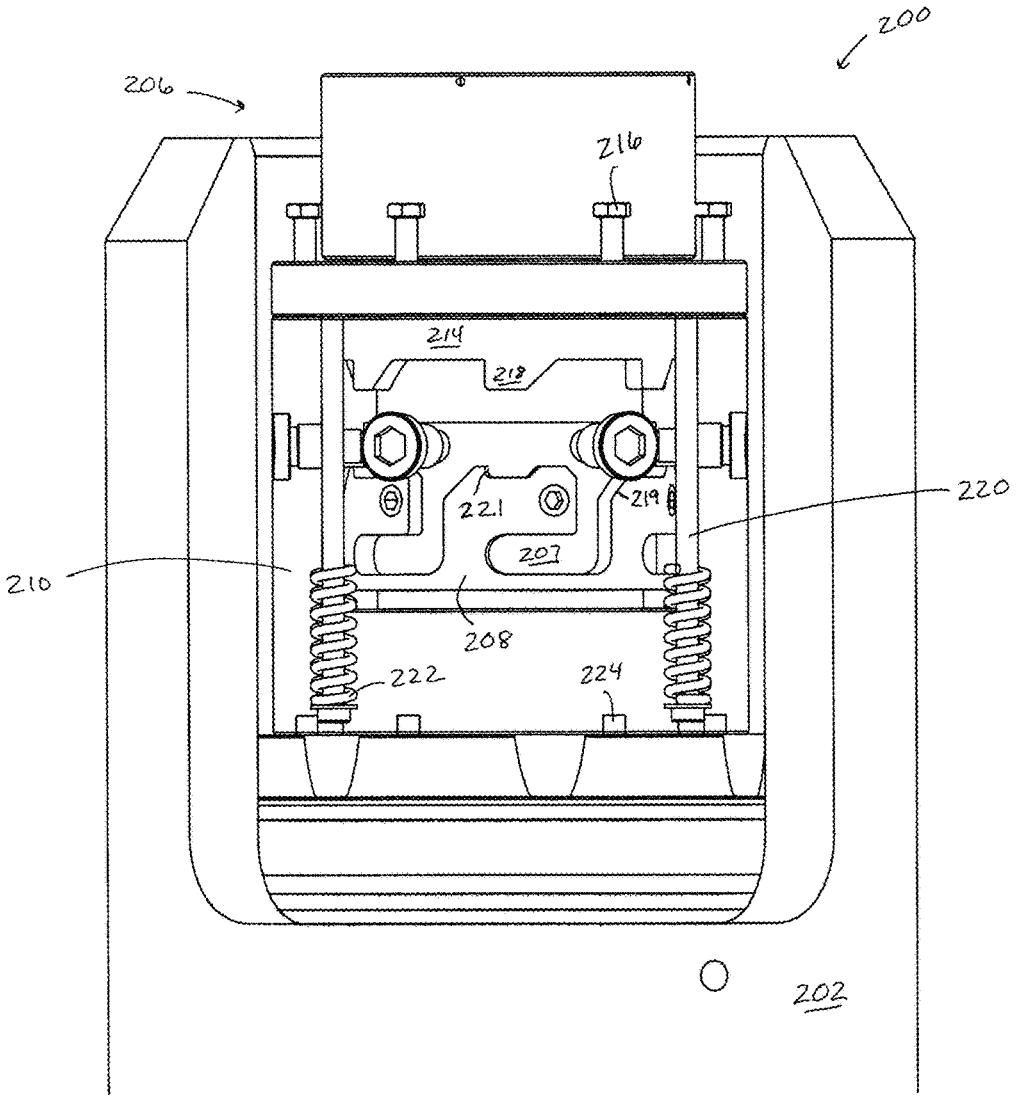

As the pins 212 reach the end 225 of the horizontal portion of the slot 207, the mandrel is in an actuation position and the pins 212 are able to move vertically along the slot 207 due to the shape of the slot 207. Weight may then be set down on the drill string, as shown in FIGS. 2D-2E, to lower the mandrel 204. In this position, the mandrel 204 may close a valve (not shown) in a lower portion of the running tool 206, and a seal assembly may be installed and pressure tested. Once the seal assembly is tested, the mandrel 204 and the collar 208 are free to rotate about corresponding vertical axes with respect to the lock open device 200. Thereafter, the mandrel 204 and the collar 208 may be rotated a predetermined number of times, for example, to release the running tool 206 from the casing string. In one or more embodiments, the mandrel 204 and collar 208 may be rotated about four times to release the running tool from the casing string. A force may be applied to the mandrel 204, raising the mandrel 204 and the collar 208. At this point, even if the one or more pins 212 do not align with corresponding slots 207 in the collar 208, the collar 208 will lift the can 210 and top plate 214 off of the dowel pins 224 allowing the running tool to be retrieved, as is known in the art.

Figure 3A:
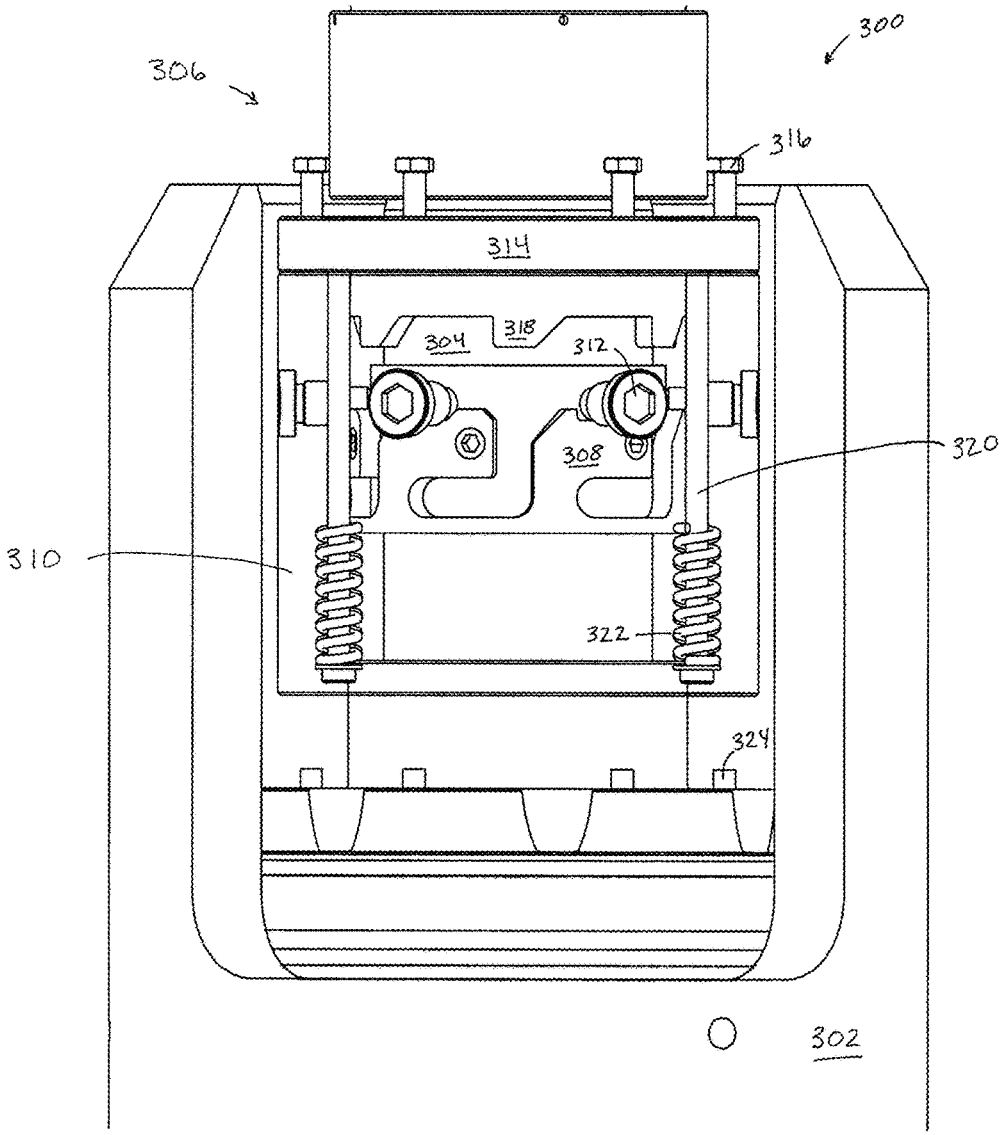
FIGS. 3A-3F are cross-sectional cut away views showing resetting of a lock open device in accordance with one or more embodiments of the present disclosure.

Referring now to FIGS. 3A-3F, cross section cut away views of resetting a lock open device in accordance with one or more embodiments are shown. In order to run the next casing string, the lock open device may need to be reset from a retrieved position, as shown in FIG. 3A, to an initial position. Similar to the above, in FIGS. 3A-3F, a lock open device 300 may include without limitation a number of components, such as for example a body 302 surrounding a mandrel 304 of a running tool 306, a collar 308, and a can 310 having one or more pins 312 configured to engage with the collar 308.

With the pins 312 sitting on top of collar 308, mandrel 304 may be rotated a predetermined number of turns, for example, to lock the running tool into a casing hanger (not shown). In embodiments, the mandrel 304 may be rotated counter-clockwise to lock the running tool into the casing hanger. However, those having ordinary skill would appreciate that one the mandrel 304 may be rotated in any direction without departing from the scope of this disclosure.

Figure 3B:
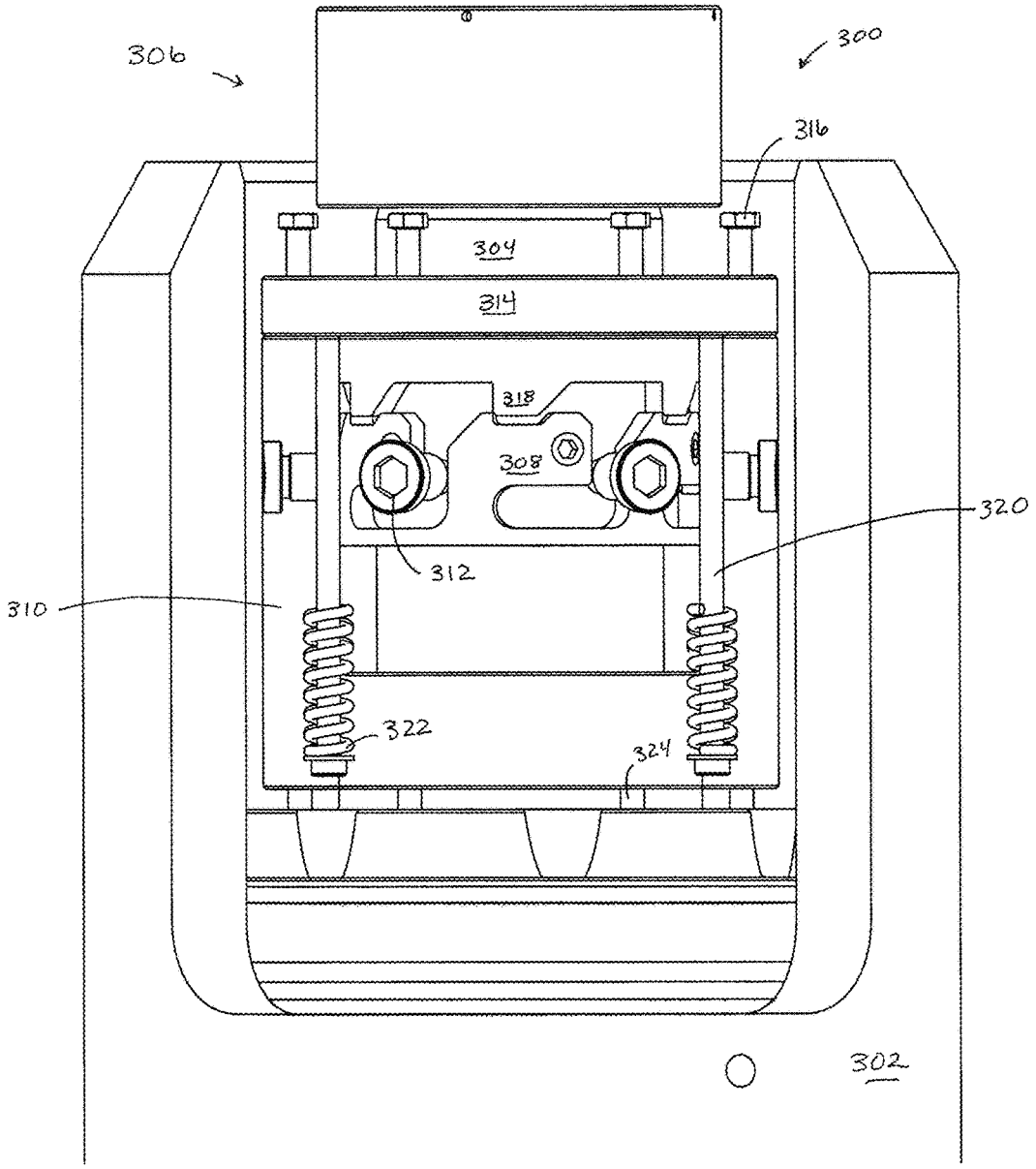

Once locked, the mandrel 304 may be rotated again in an opposite direction (e.g., clockwise) and in order to align the pins 312 disposed on the can 310 with the slots of the collar 308, can 310 may be lifted and rotated. Thereafter, the pins 312 of the can 310 may be set into the slots 307 of the collar 308, as shown in FIG. 3B.

Figure 3C:
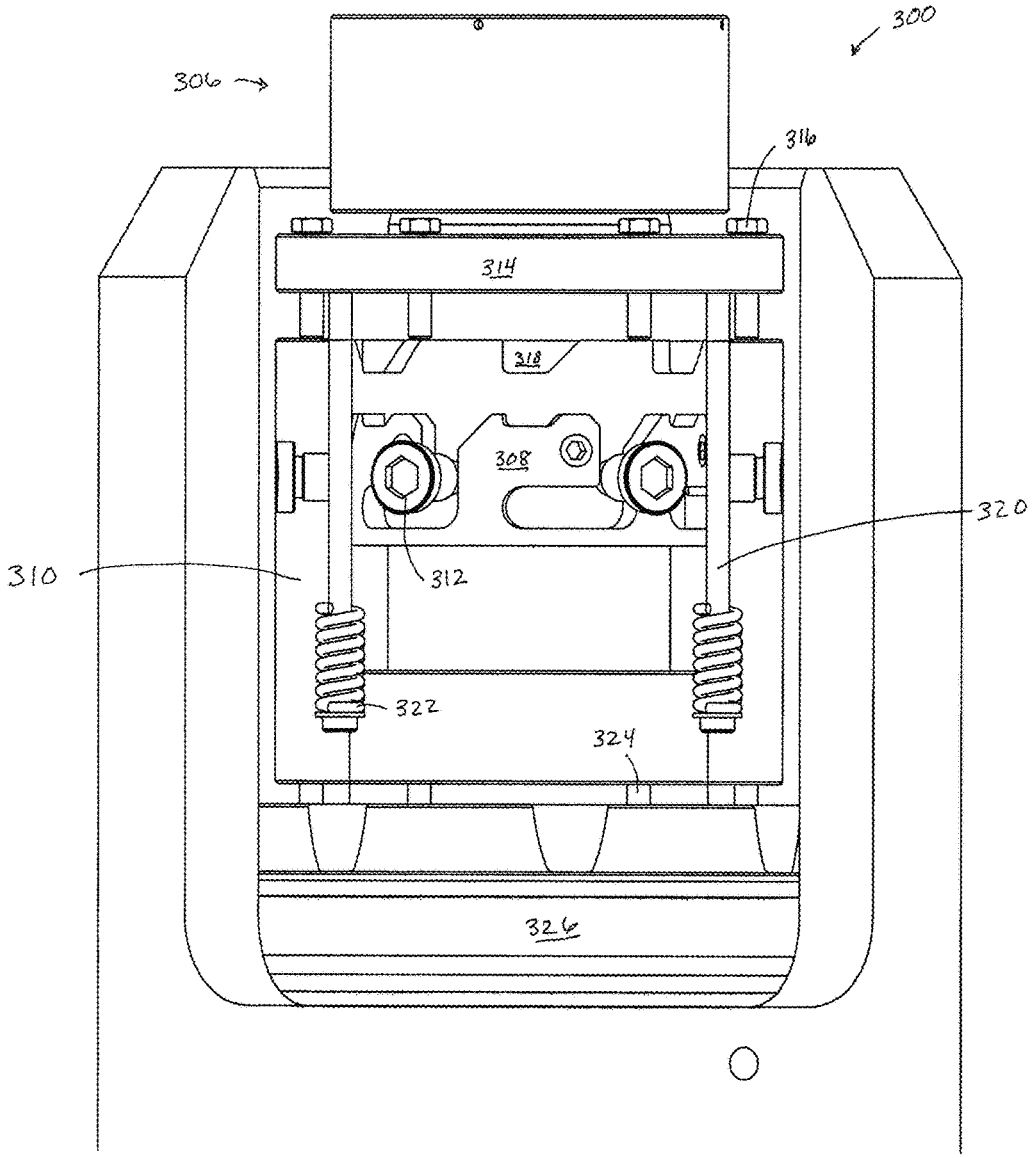
Figure 3D:
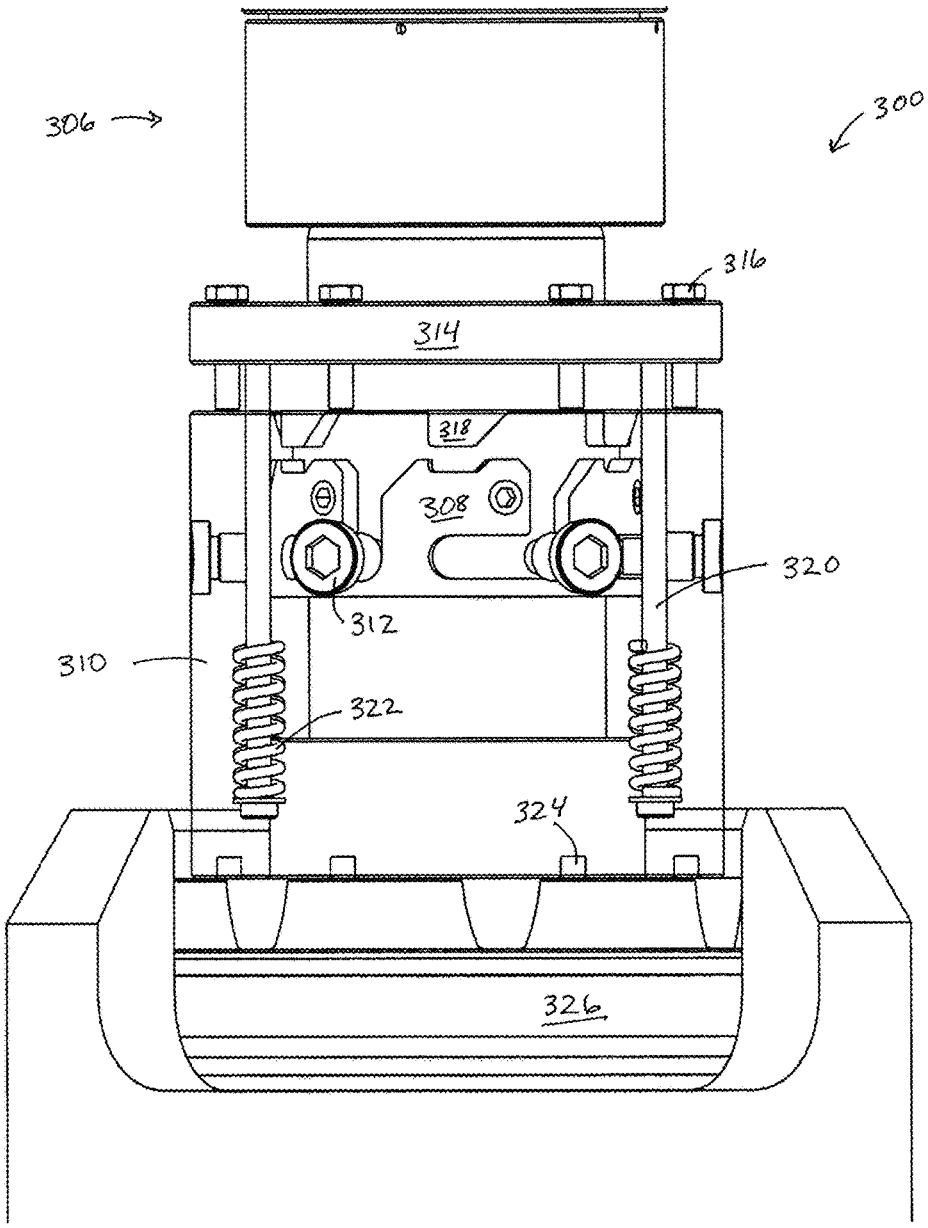

Next, screws 316 of a top plate 314 may be engaged in order to displace the top plate 314 from the can 310, as shown in FIG. 3C. This allows for one or more cogs 318 of the top plate 314 to extend above the anti-return slot (as shown in FIGS. 2B-2C). Once the one or more cogs are extended above the anti-return slot, the mandrel 304 may be rotated until dowel pins 324 align with holes in a flowtube 326, as shown in FIG. 3D.

Figure 3E:
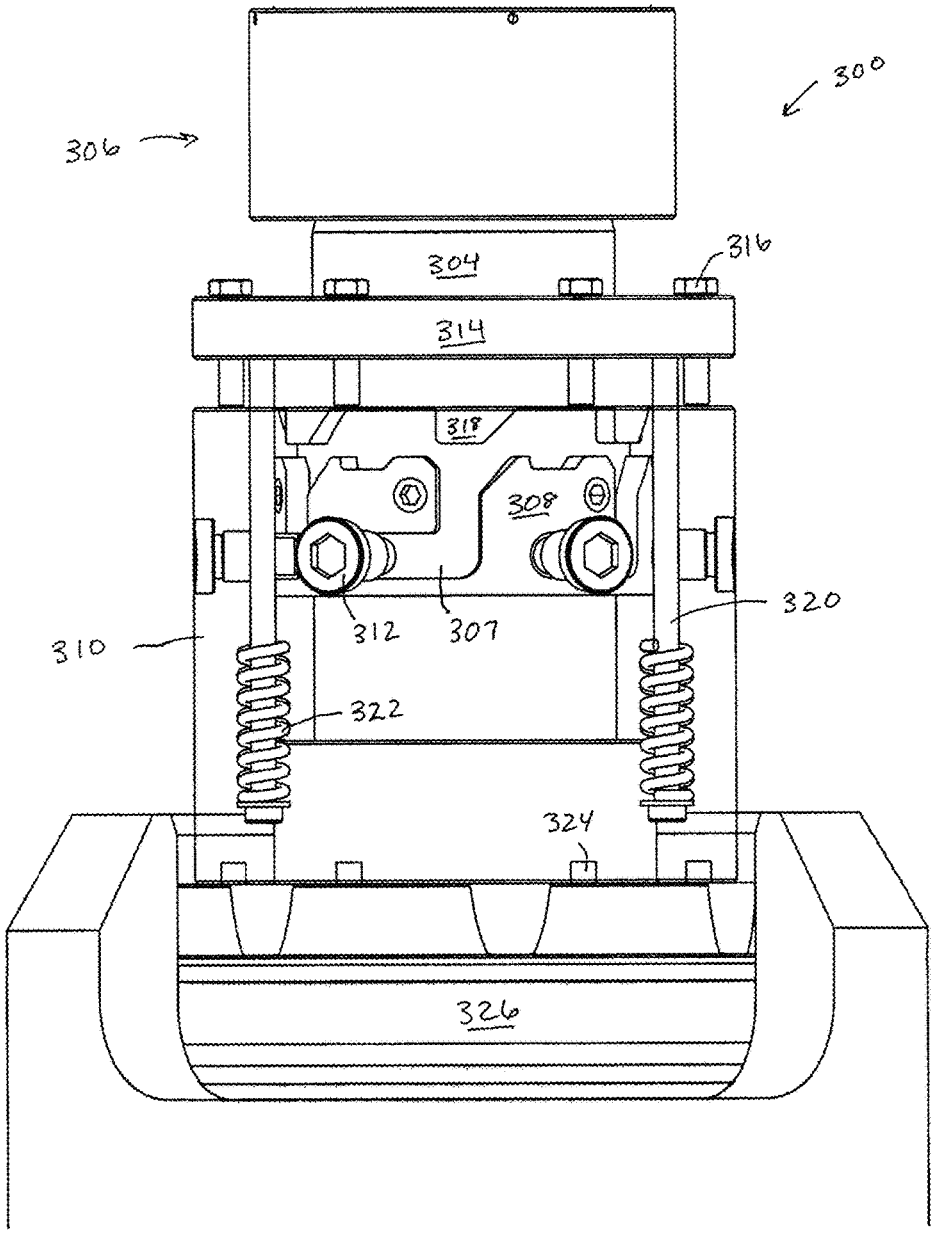
Figure 3F:
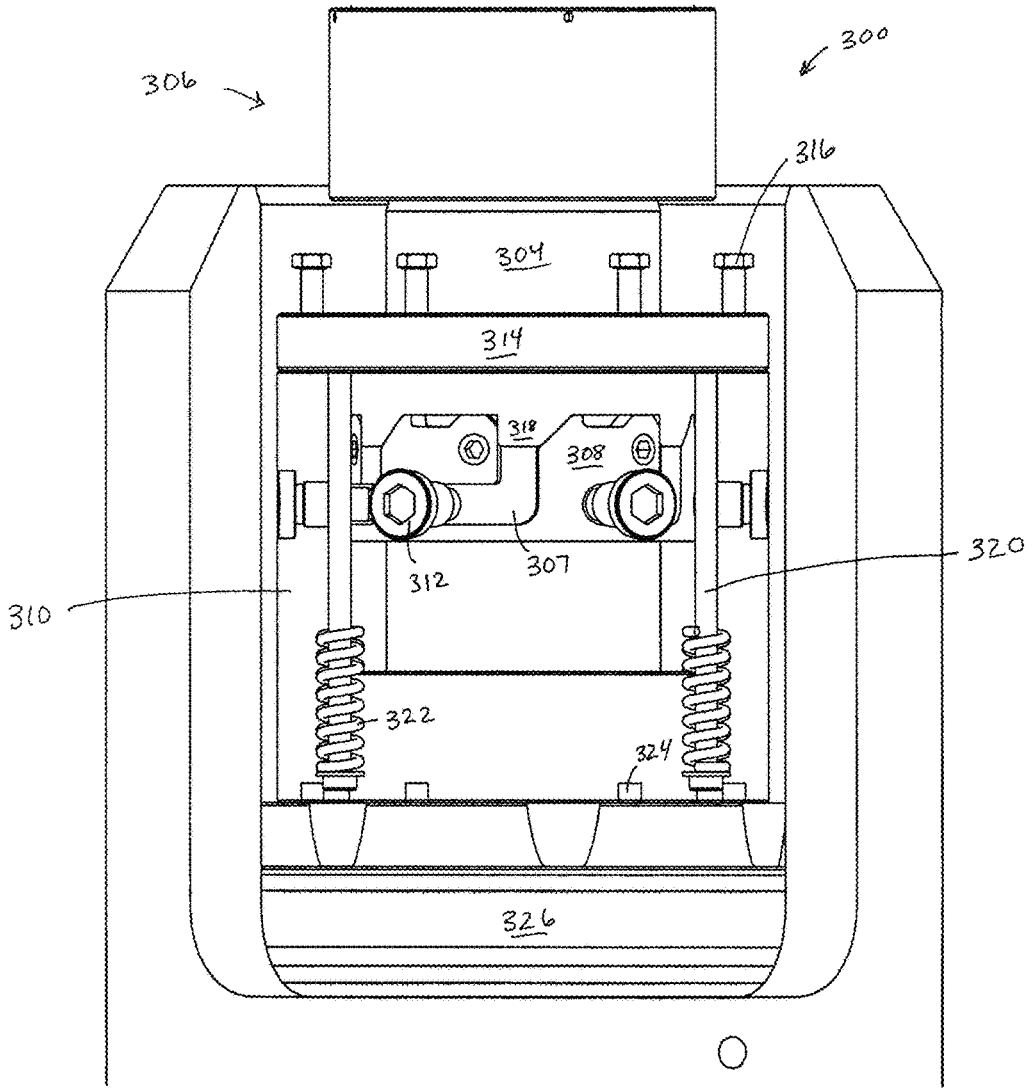

Continuing rotation of the mandrel 304 allows the pins 312 to slide along slot 307 and position the one or more cogs 318 out from the anti-return slot (as shown in FIGS. 2B-2C) and above a vertical portion of the slot 307, as shown in FIG. 3E. This enables proper arrangement and alignment of the can 310, collar 308, pins 312, and cogs 318, and the screws 316 may be disengaged. This sets the top plate 314 onto can 310 and positions the one or more cogs 318 with respect to the collar 308, as shown in FIG. 3F. In this arrangement and position, the lock open device 300 is ready to run the next casing string.

A lock open device in accordance with embodiments of the present disclosure provides a resettable and consistent method of locking a running tool in the open position when running a casing string and seal assembly into a wellhead system. In addition, as shear pins are not being used, components of the lock open device, running tool, or other equipment do not need to be replaced between runs. As a result, time for completing the well may be saved, costs may be reduced, and the overall well completion process may be more efficiently performed.

Further, in accordance with embodiments of the present disclosure, a lock open device may be easier to operate as the configuration and arrangement of the components of the lock open device account for drill wind up and other potential issues when running a casing string in deep water. In addition, one or more embodiments of the lock open device may prevent prematurely unlocking the running tool from the casing before setting the seal assembly.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is not intended to intimate that the scope of the disclosure, including the claims, is limited to that embodiment.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A lock open device for a miming tool including a mandrel, the device comprising:
   - a collar located on the mandrel of the running tool and comprising:
     - an open position profile; and
     - a slot comprising a rotational travel section and an axial travel section;
   - a top plate comprising a cog configured to engage with the open position profile to restrict the collar from relative rotation;
   - a can including a pin configured to engage with the collar slot; and
   - wherein the collar is rotatable upon overcoming a resistance of the top plate such that the pin is located in the axial travel section, allowing axial movement of the collar relative to the can.

2. The lock open device of claim 1, wherein the collar comprises a plurality of slots and the can comprises a plurality of pins, and wherein each slot of the collar is configured to be engaged with one of the pins of the can.

3. The lock open device of claim 2, wherein the slots comprise j-slots.

4. The lock open device of claim 2, wherein the collar comprises a plurality of open position profiles and wherein the top plate comprises a plurality of cogs, each profile further comprising a ramp configured to be engaged by one of the cogs of the top plate.

5. The lock open device of claim 1, wherein:
   - the collar further comprises an anti-return profile; and
   - the cog is configured to land in an anti-return slot in the anti-return profile after being rotated out of engagement with the open position profile.

6. The lock open device of claim 5, wherein the anti-return slot is configured to mate with the cog to restrict rotational movement of the collar with respect to the can.

7. The lock open device of claim 1, further comprising a biasing mechanism configured to bias the top plate down on the collar.

8. The lock open device of claim 7, further comprising a rod configured to engage with the biasing mechanism and a screw configured to allow displacement of the top plate from the can by overcoming a resistance of the biasing mechanism.

9. The lock device of claim 1, further comprising one or more dowel pins configured to be placed within holes of a flowtube in order to align the can within the lock open device.

* * * * *